US010873147B2

(12) United States Patent
Ueberschlag et al.

(10) Patent No.: US 10,873,147 B2
(45) Date of Patent: Dec. 22, 2020

(54) PROTECTED PLUG

(71) Applicant: STÄUBLI ELECTRICAL CONNECTORS AG, Allschwil (CH)

(72) Inventors: Pierre Ueberschlag, Dietwiller (FR); Michel Windenberger, Lutterbach (FR); Andrea Mastrovito, Münchenstein (CH)

(73) Assignee: STAUBLI ELECTRICAL CONNECTORS AG, Allschwil (CH)

( * ) Notice: Subject to any disclaimer, the term of this patent is extended or adjusted under 35 U.S.C. 154(b) by 0 days.

(21) Appl. No.: 16/335,736

(22) PCT Filed: Sep. 6, 2017

(86) PCT No.: PCT/EP2017/072335
§ 371 (c)(1),
(2) Date: Mar. 22, 2019

(87) PCT Pub. No.: WO2018/054685
PCT Pub. Date: Mar. 29, 2018

(65) Prior Publication Data

US 2019/0237895 A1 Aug. 1, 2019

(30) Foreign Application Priority Data

Sep. 23, 2016 (EP) ..... 16190273

(51) Int. Cl.
*H01R 13/44* (2006.01)
*H01R 13/64* (2006.01)

(52) U.S. Cl.
CPC ..... *H01R 13/44* (2013.01); *H01R 13/64* (2013.01); *H01R 2201/26* (2013.01)

(58) Field of Classification Search
USPC ..... 133/133, 732
See application file for complete search history.

(56) References Cited

U.S. PATENT DOCUMENTS 3,636,503 A * 1/1972 Bernutz ..... H01R 12/722 439/697
3,888,559 A * 6/1975 Geib ..... H01R 13/635 439/258

(Continued)

FOREIGN PATENT DOCUMENTS

DE 10 2010 035 943 A1 3/2012
EP 2 642 607 A1 9/2013

(Continued)

OTHER PUBLICATIONS

Chinese Search Report dated Dec. 9, 2019 from the China National Intellectual Property Administration in application No. 2017800585021.

(Continued)

*Primary Examiner* — Neil Abrams
(74) *Attorney, Agent, or Firm* — Sughrue Mion, PLLC

(57) ABSTRACT

A pin-side plug for electrical connection to a socket-side plug has a pin-side plug housing (6) with a plug base and a plug wall, an electrically conductive contact pin (3) with a free pin end (31) and a base-side pin end (32) for fastening the contact pin to the pin-side plug housing (6), and a protective element (5) which is designed to be electrically insulating. The protective element (5) is arranged on the pin-side plug housing (6) at a distance from the contact pin (3). The socket-side plug has a socket-side plug housing (9) with a plug base (91) and with a plug wall (92), and a socket (100) which is arranged in the socket-side plug housing (9) and is designed for receiving the contact pin (3) in the connected state. The socket-side plug housing (9) has a receptacle (93) for receiving the protective element (5) in the connected state.

40 Claims, 4 Drawing Sheets

(56) References Cited

U.S. PATENT DOCUMENTS 5,173,063 A * 12/1992 Barkus ..... H01R 13/6453 439/633
5,297,972 A * 3/1994 McMills ..... H01R 9/0506 439/133
5,391,972 A * 2/1995 Gardner ..... H01M 2/1055 320/115
5,447,454 A * 9/1995 Inaba ..... H01R 13/518 439/299
5,588,852 A * 12/1996 Puerner ..... H01R 13/44 439/135
5,703,324 A * 12/1997 Harder ..... H01R 24/28 174/21 C
6,113,426 A * 9/2000 Lin ..... H01R 12/725 439/607.43
6,113,436 A * 9/2000 Kuwahara ..... H01R 13/44 439/693
6,899,556 B2 * 5/2005 Nishida ..... H01R 13/639 200/51.1
7,179,100 B2 * 2/2007 Montena ..... H01R 13/5202 439/133
7,824,210 B2 * 11/2010 Oka ..... H01R 13/44 439/372
8,062,041 B2 * 11/2011 Nakamura ..... H01R 13/64 439/108
8,298,022 B2 * 10/2012 Tsuruta ..... H01R 13/03 439/886
8,545,275 B2 * 10/2013 Wang ..... H01R 13/44 439/680
8,597,062 B2 * 12/2013 Casses ..... H01R 13/64 439/686
8,734,191 B2 5/2014 Zhao
8,827,741 B2 * 9/2014 Johnson ..... H01R 13/518 439/541.5
8,858,258 B2 * 10/2014 Stokowski ..... H01R 13/533 439/582
9,004,954 B2 * 4/2015 Baldwin ..... H01R 13/6456 439/680
9,065,199 B2 * 6/2015 Mizutani ..... H01R 13/629
9,444,205 B2 * 9/2016 Rangi ..... H01R 13/658
9,647,372 B2 * 5/2017 Eckel ..... H01R 24/66
9,787,020 B2 * 10/2017 Choi ..... H01R 24/28
9,787,023 B2 * 10/2017 Nakazawa ..... H01R 4/184
10,122,131 B2 * 11/2018 Stevens ..... H01R 24/40
10,128,624 B2 * 11/2018 Tyler ..... H01R 13/62938
10,205,274 B2 * 2/2019 Loncar ..... H01R 4/56
10,305,219 B2 * 5/2019 Zebhauser ..... H01R 13/5025
10,355,389 B2 * 7/2019 Reedy ..... H01R 13/44
10,381,752 B2 * 8/2019 Kaehny ..... H01R 11/11
10,553,996 B2 * 2/2020 Yamanashi ..... H01R 13/187
10,608,364 B2 * 3/2020 Blakborn ..... H01R 13/2421
2009/0117786 A1 * 5/2009 Westkamp ..... H01R 13/631 439/676
2019/0237895 A1 * 8/2019 Ueberschlag ..... H01R 13/44
2020/0014140 A1 * 1/2020 Duenkel ..... H01M 2/30

FOREIGN PATENT DOCUMENTS

WO 2006/105987 A 10/2006
WO 2014/187908 A1 11/2014

OTHER PUBLICATIONS

International Search Report for PCT/EP2017/072335 dated, Nov. 7, 2017 (PCT/ISA/210).

* cited by examiner

PROTECTED PLUG

CROSS REFERENCE TO RELATED APPLICATIONS

This application is a National Stage of International Application No. PCT/EP2017/072335 filed Sep. 6, 2017, claiming priority based on European Patent Application No. 16190273.9, filed Sep. 23, 2016.

TECHNICAL FIELD

The present invention relates to a pin-side plug for electrical connection to a socket-side plug according to the preamble of claim 1.

PRIOR ART

For establishing electrical and/or electronic connections between various components, lines or the like, plug-in connections consisting of a plug element and a socket element are known. Often, the plug element has in this case one or more contact elements, which are inserted into one or more corresponding socket contacts in the socket element. In the case of electric or hybrid vehicles driven entirely or partially by electrical power, very great currents and/or voltages are transmitted by way of the plug elements, and consequently by way of their contact elements.

Because of the high currents or voltages, the plug elements have to meet particularly high safety requirements in order to prevent a human finger from unintentionally touching the contact elements. A corresponding test can be performed using a so-called test finger, which conforms to a prescribed standard IEC 60529 and is pressed with a prescribed testing force against portions or openings of the plug element in which the contact element or elements is or are located. In this test, the test finger must not come into contact with the current-carrying portions of the contact elements.

Various possible ways in which such unwanted contact by a finger can be prevented are known from the prior art.

For example, U.S. Pat. No. 8,734,191 B2 discloses a plug with a contact, there being an insulating cap on the contact and lateral protective shrouds surrounding the contact on all sides.

WO 2014/187908 discloses a plug in which the contact is partially surrounded by a protective shroud, and also a plug in which the protective shroud is formed in one piece with an insulating cap for the contact.

However, the provision of protective elements to provide protection from any contact leads to an increased space requirement or lack of space, which is disadvantageous, in particular in the case of plugs with a number of contact elements.

SUMMARY OF THE INVENTION

The object of the present invention is therefore to provide a plug that overcomes the disadvantages of the prior art. In particular, a plug that has a compact construction is provided. A further particularly preferred object is to provide a plug that provides a particularly good and constant electrical contact.

This object is achieved according to the invention by a plug according to claim 1 or claim 17.

According to claim 1, a pin-side plug for electrical connection to a socket-side plug is provided, having a pin-side plug housing with a plug base and a plug wall, an electrically conducting contact pin with a free pin end and a base-side pin end for fastening the contact pin to the pin-side plug housing, and a protective element, which is designed to be electrically insulating. The protective element is arranged on the pin-side plug housing at a distance from the contact pin.

The protective element prevents unwanted touching of the contact pin by a finger or the like.

The distance also makes it possible that the entire circumferential side of the contact pin is electrically enclosed by a socket.

As also explained below, the pin-side plug may have one or more contact pins, one or more protective elements then preferably being provided. Preferably, there is one protective element arranged for each contact pin. Therefore, whatever is said here in relation to a contact pin or protective element should be understood as applying correspondingly to one or more contact pins or protective elements.

Preferably, the protective element is formed separately from the contact pin. In other words, the protective element is therefore a component that is formed separately and arranged separately from the contact pin.

Preferably, between the protective element and the contact pin there is a spatial region that is not filled with components. The protective element is preferably arranged at a distance in such a way that the protective element does not come into contact with a lateral surface of the contact pin.

The contact pin is preferably cylindrically formed and extends along a center axis, from the base-side pin end in the direction of the free pin end.

The plug wall is preferably designed to be electrically insulating and is arranged on the pin-side plug housing at a distance from the contact pin.

The plug wall, preferably the entire pin-side plug housing, may therefore likewise be formed from an electrically insulating material, so that the protective element and also the plug wall together form an electrically insulating covering region for the contact pin. The plug wall may be understood as an additional protective element for the contact pin.

Preferably, the protective element is arranged at a distance from the plug wall. That is to say that it is preferred that the protective element is arranged on the pin-side plug housing at a distance from the contact pin and also from the plug wall.

The plug wall extends at least partially along a circumferential direction around the contact pin. The plug wall is in this case preferably positioned in relation to the contact pin in such a way that a test finger cannot be pushed between the plug wall and the contact pin. Seen transversely in relation to the center axis, the plug wall may at least in certain portions be formed in cross section as a segment of a circle, or in a polygonal or rectangular or square manner or a mixture thereof. Preferably, the plug wall extends in a circular-cylindrical manner around the center axis of the contact pin.

The protective element and the plug wall are preferably arranged virtually concentrically or eccentrically around the contact pin. In the case of a concentric arrangement, the protective element and the plug wall are therefore arranged in each case along a circumferential direction around the contact pin at approximately the same distance from the contact pin. In the case of an eccentric arrangement, the plug wall extends around an axis that lies parallel to the center axis of the contact pin.

The plug wall may be circumferentially interrupted and the protective element may be arranged in an interruption of the plug wall or in the region of an interruption. The plug wall may have one interruption, the protective element being arranged in this one interruption. The plug wall may however also have a number of interruptions, so that a multipart plug wall extends around the contact pin, the individual parts of the plug wall being arranged at a distance from one another and the protective element preferably being arranged between two such parts.

It is however also conceivable that the plug wall is not circumferentially interrupted and instead is formed in one piece.

Preferably, the protective element has a first portion, which is oriented along a first direction, and a second portion, which is oriented along a second direction, in particular at an angle to the first direction, and is intended for providing reinforcement with respect to a deformation of the first portion. In the case of the first portion of the protective elements being touched by a finger or the like, the second portion of the protective element therefore ensures that the first portion, in particular the entire protective element, is not deformed or bent as a result of the pressure from the contact.

The protective element is preferably formed in a substantially U-shaped manner, the first portion being formed by a base leg and the second portion being formed by two side legs projecting from the latter and lying opposite one another, the side legs facing the contact pin. The first direction in this case preferably extends perpendicularly to the center axis of the contact pin, and the second direction in turn preferably extends perpendicularly to the first direction.

Preferably, the protective element, in particular the base leg and the side legs, and/or the plug wall extend substantially along an entire length of the contact pin, from the plug base in the direction of the free end of the contact pin.

The base leg preferably has a width, seen transversely in relation to the center axis, that substantially corresponds to a width of the contact pin. That is to say that the base leg substantially covers an entire width of the contact pin.

Preferably, the protective element has a length that is at least as long in the direction of the center axis as the contact pin in the same direction. Particularly preferably, the protective element is made longer than the contact pin.

It is preferred that the plug wall has two parallel wall surfaces on its inner surface, facing the contact pin, which parallel wall surfaces are arranged lying opposite one another with respect to the center axis extending along the contact pin, from the base-side pin end in the direction of the free pin end, and/or are arranged in each case at an equal distance from the center axis.

The plug wall preferably has an arcuate portion, which connects the two parallel wall surfaces to one another in an arcuate manner. The parallel wall surfaces are preferably formed in a rectangular manner and extend along the entire length of the plug wall, from the base-side pin end in the direction of the free pin end.

Preferably, the protective element is arranged with respect to the plug wall in a plane that is defined by the center axis and by an arc center point of the arcuate portion, and with the protective element being arranged in this plane midway between the parallel wall surfaces.

In other words, the protective element is arranged in an interruption of the plug wall, the arcuate portion of the plug wall being arranged on the opposite side of the protective element and the two parallel wall surfaces being arranged on the sides of the interrupted plug wall that are adjacent to the protective element.

The plug wall may have groovings on the outside or on the inside respectively in the region of the parallel wall surfaces. These groovings may for example take the form of elongate slits, which extend substantially along the entire length of the plug wall, from the plug base in the direction of the free pin end. The groovings allow the plug wall to be reinforced. This is in particular on condition that production is simplified by means of an injection-molding process. Preferably, the groovings are formed in such a way that there is no excessive accumulation of material, but a mechanically sturdy wall is nevertheless provided. The groovings have in particular the advantage that the plug wall is mechanically robust with respect to transverse forces that are applied by a test finger.

Preferably, the protective element and/or the plug wall is formed in one piece with the plug housing and they form a protective arrangement for the contact pin.

Preferably, the pin-side plug has two or more contact pins, each contact pin having in each case a protective element, preferably likewise at least in each case a plug wall, particularly preferably in each case a protective arrangement. That is to say that a protective arrangement is preferably provided for each contact pin.

Preferably, for this purpose the protective element and the plug housing are produced in one piece in one production step, in particular at the same time.

It is however also conceivable that the protective element is produced separately from the plug housing and, after production, is led through the pin-side plug housing, for example through a corresponding clearance in the plug base, and fastened therein. Furthermore, it is conceivable that the protective element and/or the plug wall are produced separately and are subsequently arranged on an electrically insulating protective element base, which extends at least partially or completely around the contact pin.

Preferably, an electrically insulating contact protection, preferably in the form of a protective cap, is arranged on the free end of the contact pin.

Furthermore, according to claim 11, a socket-side plug is provided for electrical connection to a pin-side plug as described above. The socket-side plug has in this case a socket-side plug housing with a plug base and a plug wall, and a socket, which is arranged in the socket-side plug housing and is designed for receiving the contact pin in the connected state. The socket-side plug housing has a receptacle for receiving the protective element in the connected state.

If the pin-side plug and the socket-side plug are connected to one another, the protective element is received in the receptacle of the socket-side plug and a plug-in connector system of a compact construction is provided.

Here, too, it should be understood that the socket-side plug may have one or more sockets and receptacles, depending on the number of contact pins or protective arrangements of the pin-side plug.

Preferably, the receptacle at least partially encloses the protective element in the connected state, with the protective element preferably being able to fit exactly in the receptacle and/or the receptacle preferably being designed for receiving substantially the entire length of the protective element.

The receptacle preferably has a substantially rectangular shape, the inner surfaces of which have play in relation to the outer surfaces of the protective element in the connected state. Preferably, the receptacle surrounds the protective element substantially completely in the region of the receptacle.

For example, for receiving with an exact fit a protective element that is U-shaped in the way described above, the inner form of the receptacle facing the protective element may be formed in such a way that it has an inner surface that is arcuate in a way corresponding to the arcuate base leg of the protective element, and also has in each case two inner surfaces, aligned parallel to one another, that are straight in a way corresponding to the straight side legs of the protective element.

The socket-side plug housing preferably has a further clearance, in particular in the form of a circle, in which the plug wall, in particular in the form of a segment of a circle, can be received. In the case of one or more contact pins, the socket-side plug housing preferably likewise has one or more clearances.

Preferably, a contact element, in particular a contact lamella, which is designed for electrical contacting with the contact pin of the pin-side plug, is arranged in the socket.

In the connected state, therefore, electrical contacting between the contact pin and the socket takes place by way of said contact element.

Preferably, the socket is arranged in a conductor element. Said receptacle for the protective element extends into the conductor element. In other words, the conductor element has a clearance, into which the receptacle of the protective element extends. Consequently, the protective element therefore protrudes through the receptacle of the plug element and through the clearance in the conductor element. The current path in the conductor element in this case runs laterally in relation to the clearance.

Preferably, said clearance lies under the socket.

Particularly preferably, the receptacle is arranged in the conductor element in such a way that the protective element is surrounded by the conductor element exclusively on its circumferential side, but not at its end face. The circumferential side is in this case the side of the protective element that is formed by parts of the lateral surface extending around the center axis. The end face is the side of the protective element that is oriented at right angles to the center axis and closes off the protective element in the forward direction.

On account of the fact that the receptacle extends into the conductor element, the advantage that the socket side can be formed more compactly is obtained.

In the particularly preferred embodiment, the receptacle is provided both by the socket-side plug housing and by the conductor element.

Preferably, the conductor element has a connection region for a cable and in particular is formed at an angle or parallel to the plug base of the socket-side plug housing. For example, the connection region may be arranged perpendicularly to the plug base. In the case of the right-angled configuration, the arrangement of the clearance in the conductor element is particularly advantageous, because then the protective element can protrude into the clearance in the plugging direction.

By analogy, the pin-side plug may also have a connection region for a cable, which may likewise be formed at an angle, in particular perpendicularly, or parallel to the pin-side plug housing.

Further embodiments are provided in the dependent claims.

BRIEF DESCRIPTION OF THE DRAWINGS

Preferred embodiments of the invention are described below on the basis of the drawings, which merely serve for explanation and are not to be interpreted as restrictive. In the drawings.

DESCRIPTION OF PREFERRED EMBODIMENTS

Figure 4:
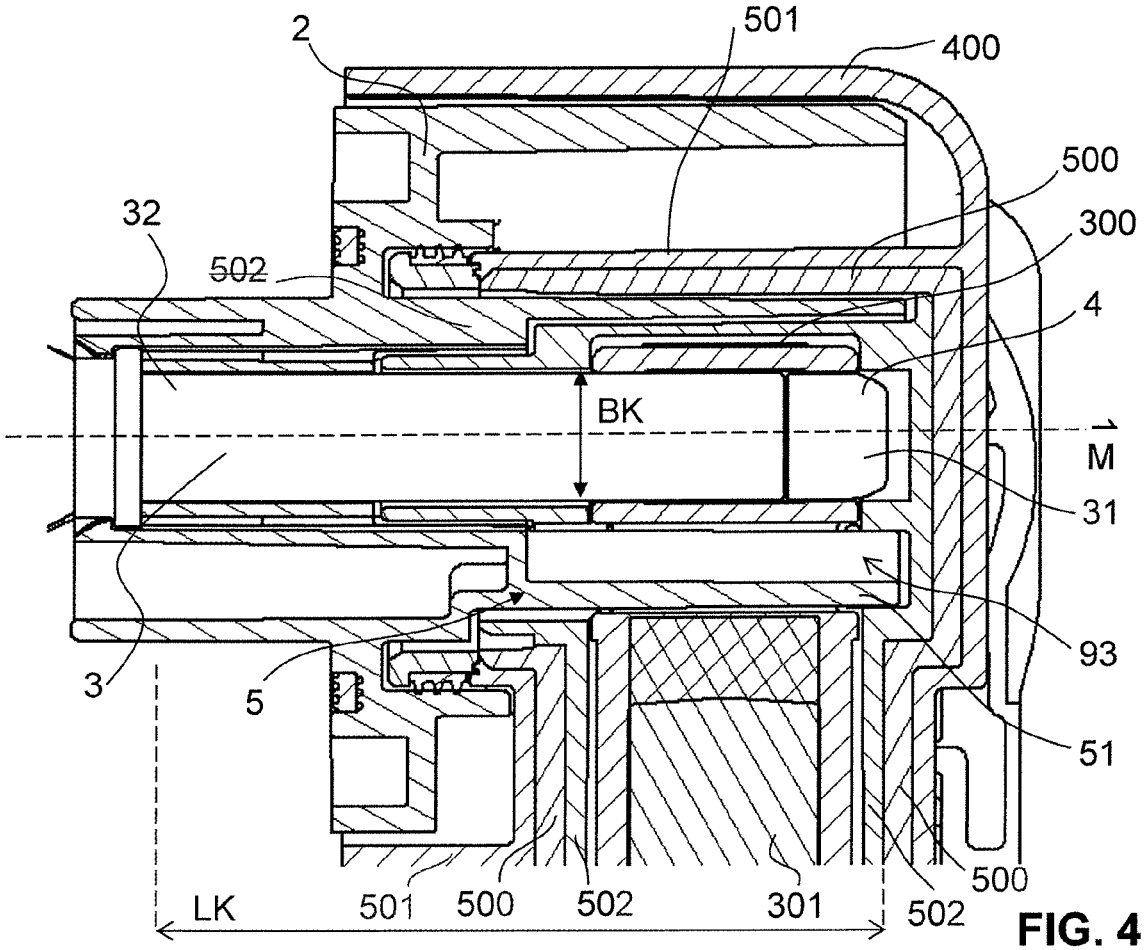
FIG. 4 shows a longitudinal section through the pin-side plug and the socket-side plug according to FIGS. 1 and 2 in the connected state.

FIGS. 1 to 4 show various views of a pin-side plug S and a socket-side plug B in each case individually (FIGS. 1 and 2), in the unconnected state (FIG. 3) and in the connected state (FIG. 4).

Figure 1:
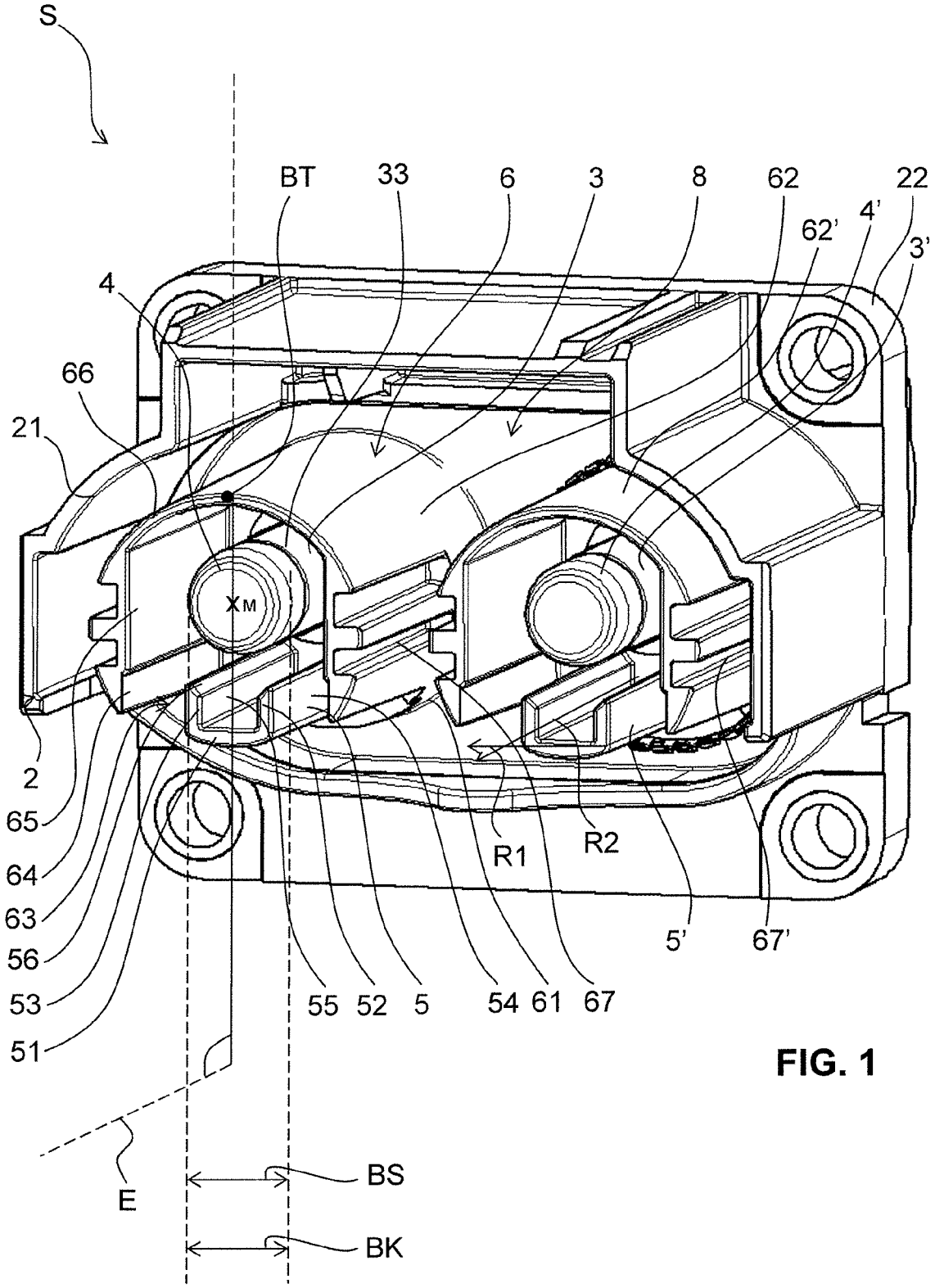
FIG. 1 shows a perspective view of a pin-side plug.

As revealed in particular by FIG. 1, the pin-side plug S has a pin-side plug housing 6 with a plug base 61 and a plug wall 62, 62'. The plug housing 6 is arranged here on a pin-side mounting 2, which in turn has a housing mounting 21 and also a housing base 22. Arranged on the plug base 61 are two electrically conducting contact pins 3, 3', which have in each case a free pin end 31, 31' and a base-side pin end 32, 32'. The contact pins 3, 3' are fastened with their base-side pin end 32, 32' to the pin-side plug housing 6.

Also provided are two electrically insulating protective elements 5, 5', which are arranged on the pin-side plug housing 6 in each case at a distance from the contact pins 3, 3'. The pin-side plug housing 6 has here a plug wall 62, 62' formed as a segment of a circle, with in each case a wall 62, 62' in the form of a segment of a circle at least partially surrounding a contact pin 3, 3' along a circumferential direction around the respective contact pin 3, 3'.

Although two contact pins 3, 3' with corresponding protective elements 5, 5' and plug walls 62, 62' are respectively represented in the figures shown here, only one such contact pin with one protective element and one plug wall or three or more such contact pins with in each case three or more protective elements and three or more plug walls may be provided.

The plug walls 62, 62' and the protective element 5, 5' are arranged in such a way that a test finger or else a human finger is prevented from being able to touch the contact pin 3, 3'.

The protective element 5, 5' is in this case respectively formed separately from the contact pin 3, 3' and arranged at a distance from the contact pin 3, 3' in such a way that it does not come into contact with the lateral surface 33, 33' of the cylindrical contact pin 3, 3'. The plug wall 62, 62' of the pin-side plug housing 6 is likewise designed to be electrically insulating and is arranged at a distance from the contact pins 3, 3' and also from the protective elements 5, 5' on the pin-side plug housing 6. The plug wall 62, 62' can consequently be understood as a further electrically insulating protective element for preventing unwanted touching of the contact pin 3, 3'.

The protective elements 5, 5' and the plug walls 62, 62' are in this case respectively arranged virtually concentrically around the corresponding contact pin 3 3' and extend substantially along an entire length LK of the contact pin 3, 3', from the pin-side plug base 61 in the direction of the free end 31, 31' of the contact pin 3, 3'.

As already mentioned, the plug wall 62, 62' only extends partially around the contact pin 3, 3' and has an interruption 63, 63', the protective element 5, 5' being arranged in the region of this interruption 63, 63' on the pin-side plug housing 6. In the embodiments shown here, the plug wall 62, 62' is circumferentially interrupted precisely once, although it is also conceivable for there to be a number of such interruptions. The protective element 5, 5' is in each case arranged at the same radial distance from the contact pin 3 3' as the plug wall 62, 62' is arranged from the contact pin 3, 3'.

The protective element 5, 5' is formed here in a substantially U-shaped manner and has a first portion 51, 51' in the form of a base leg, which extends along a first direction R1. The protective element 51, 51' also has a second portion 52, 52', 53, 53' in the form of side legs lying opposite one another, which project from the base leg 51, 51' and extend along a second direction R2. In the case of a U-shaped protective element 5, 5', the second direction R2 extends substantially perpendicularly to the first direction R1. In other words, the side legs 52, 52', 53, 53' are arranged substantially perpendicularly to the base leg 51, 51' and in this case are facing the contact pin 3, 3'. The side legs 52, 52', 53, 53' serve for reinforcing the base leg 51, 51' with respect to a deformation of the base leg 51, 51'. The base leg 51, 51' has here a width BS, which substantially corresponds to a width BK of the contact pin 3, 3'.

The length of the protective element 5, 5', seen in the direction of the center axis M, is preferably greater than the length of the contact pin. The contact pin extends substantially in the direction of the center axis or the lateral surface of the contact pin.

The outer shape 54, 54' of the U-shaped protective element 5, 5' is in this case formed in such a way that the base leg 51, 51' has an arcuate outer surface 54, 54', while the side legs 52, 52', 53, 53' are in each case provided with straight outer surfaces 54, 54' aligned parallel to one another. By contrast, the inner shape 55, 55', facing the contact pin 3, of the U-shaped protective element 5, 5' is such that both the base leg 51, 51' and the side legs 52, 52', 53, 53' have in each case straight inner surfaces 55, 55', with the inner surfaces 55, 55' of the side legs 52, 52' 53, 53' being substantially perpendicular to the inner surface 55, 55' of the base leg 51, 51'. As can be seen in particular from FIG. 1, the side legs 52, 52', 53, 53' respectively have at their free ends 57, 57', facing the contact pin 3, 3', a sloping end face, which is in each case formed in an inclined manner, from the outer surface 54, 54' of the side leg 52, 52', 53, 53' in the direction of the inner surface 55, 55' of the side leg 52, 52', 53, 53'.

The plug wall 62, 62' of the pin-side plug housing 6 has on its inner surface 64, 64' facing the contact pin 3, 3' two parallel wall surfaces 65, 65', which are arranged lying opposite one another with respect to a center axis M extending along the contact pin 3, 3', from the base-side pin end 32, 32' in the direction of the free pin end 31, 31', and are in each case arranged at an equal distance from the center axis M. Moreover, the plug wall 62, 62' has an arcuate portion 66, 66', which connects the two parallel wall surfaces 65, 65' to one another in an arcuate manner. The wall surfaces 65, 65' may be arranged on the inside and on the outside. The protective element 5, 5' is arranged with respect to the plug wall 62, 62' in a plane E that is defined by the center axis M and by an arc center point B of the arcuate portion 66, 66' of the plug wall 62, 62'. The protective element 5, 5' is in this case arranged in this plane E midway between the parallel wall surfaces 65, 65'. In other words, the plug wall 62, 62' is formed with its arcuate portion 66, 66' and with the portion having the parallel wall surfaces 65, 65' substantially as a segment of a circle, the protective element 5, 5' being arranged in an interruption 63, 63' and also in particular on a circular line of this plug wall 62, 62' in the form of a segment of a circle. The arcuate portion 66, 66' extends around an axis lying parallel to the center axis.

The plug wall 62, 62' also has a grooving 67, 67' respectively on the outside, that is to say on its outer side facing the housing mounting 21, in the region of the parallel wall surfaces 65, 65'. These groovings 67, 67' take the form of elongate slits, which extend substantially along the entire length of the plug wall 62, 62', from the plug base 61 in the direction of the free pin end 31, 31'.

In the embodiment shown here, the protective element 5, 5' and the plug wall 62, 62' are formed in one piece with the plug housing 6 and these together form a protective arrangement 8, 8' for the contact pin 3, 3'.

As already mentioned, two contact pins 3, 3' with corresponding protective elements 5, 5' and plug walls 62, 62' are respectively represented in the figures shown here, although it also possible for only one such contact pin with a protective element and a plug wall or a number of such contact pins with respective protective elements and plug walls to be provided. Correspondingly, one protective arrangement for one contact pin or two or more protective arrangements for two or more contact pins may be provided. To put it another way, for each contact pin an associated protective arrangement is provided.

Respectively provided at the free end 31, 31' of the contact pin 3, 3' is an electrically insulating protective cap 4, 4', which serves as an additional electrically insulating contact protection against unwanted touching of the contact pin 3, 3'. The protective cap 4, 4' extends completely around the center axis M and covers the entire free end 31, 31' of the contact pin 3, 3'. On account of the protective arrangement 8, 8', which provides a lateral protective effect for the contact pin 3, 3', and the protective cap 4, 4', which provides an upper protective effect for the contact pin 3, 3', it is made almost impossible for the contact pin 3, 3' to be touched.

Figure 2:
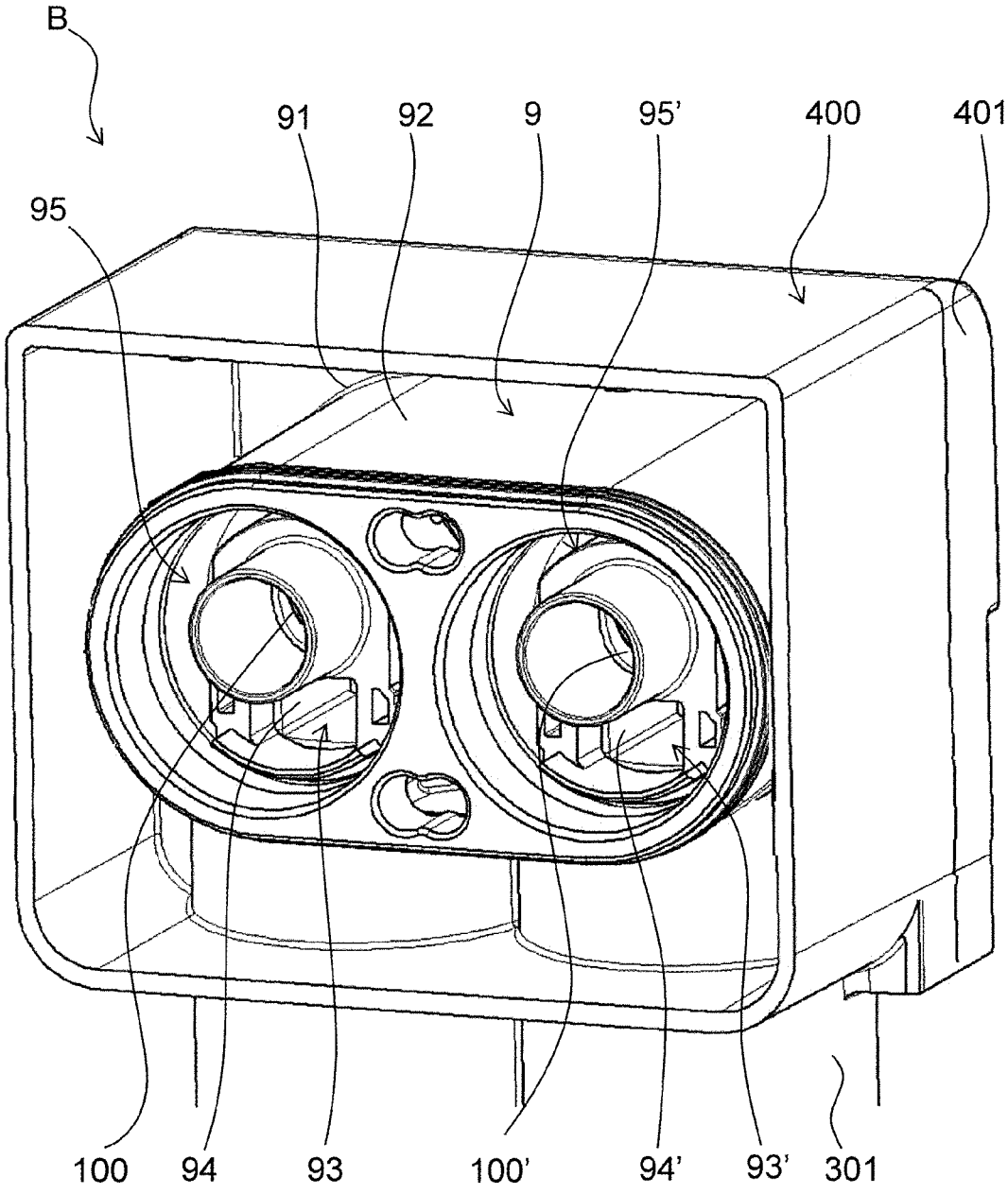
FIG. 2 shows a perspective view of a socket-side plug.
Figure 3:
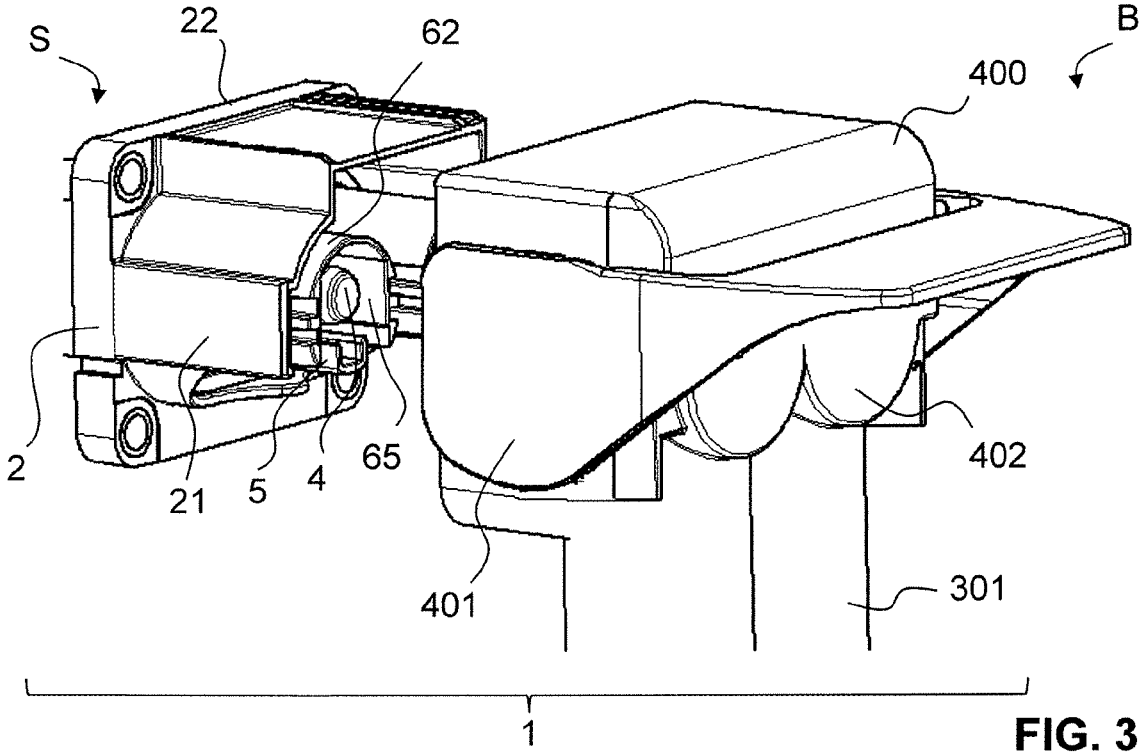
FIG. 3 shows a perspective view of the pin-side plug and of the socket-side plug according to FIGS. 1 and 2 in the unconnected state.

FIG. 2 shows a socket-side plug B for electrical connection to a pin-side plug S as described above. This socket-side plug B has a socket-side plug housing 9 with a plug base 91 and a plug wall 92. The socket-side plug housing 9 is likewise arranged on a socket-side mounting 400, which in turn has a socket-side housing mounting 401 and also a socket-side housing base 402. A socket 100, 100', which is designed for receiving the contact pin 3, 3' in the connected state, is arranged in the socket-side plug housing 9. Also arranged on the socket side is a receptacle 93, 93' for receiving the protective element 5, 5' in the connected state. The receptacle 93, 93' in the present case extends both through the plug housing 9 and through the conductor element 300.

Here, the socket-side plug housing 9 has two such receptacles 93, 93' for the two contact pins 3, 3' of the pin-side plug S. If the pin-side plug S has one or more contact pins, the socket-side plug housing 9 has one or more receptacles. In other words, the socket-side plug housing 9 therefore respectively has a receptacle for each contact pin.

As revealed in particular by FIG. 4, in the connected state the protective element 5, 5' fits exactly in the receptacle 93, 93' of the socket-side plug B, the receptacle 93, 93' at least partially enclosing the protective element 5, 5'. The receptacle 93, 93' has for this purpose a substantially rectangular shape, the inner surfaces 94, 94' of which in the connected state surround the outer surfaces 54, 54' of the protective element 5, 5', at least in certain portions.

For the exact fit of a U-shaped protective element 5, 5' as described above, the inner shape 94, 94', facing the protective element 5, 5', of the receptacle 93, 93' is formed in such a way that it has an inner surface that is arcuate in a way corresponding to the arcuate base leg 51, 51', and also has in each case two inner surfaces, aligned parallel to one another, that are straight in a way corresponding to the straight side legs 52, 52' 53, 53'.

In addition to the receptacle 93, 93' of the protective element 5, 5', the socket-side plug housing 9 has a further clearance 95, 95', in particular in the form of a circle, in which the plug wall 62, 62', in particular in the form of a segment of a circle, can be received. This clearance 95, 95' extends here completely around the socket 100, 100' and also the receptacle 93, 93'. Here, too, it should be understood that a socket and a clearance are respectively provided for each contact pin.

Consequently, the pin-side plug S and the socket-side plug B can be joined together to form a plug-in connector system 1, each contact pin 3, 3' and each associated protective arrangement 8, 8' of the pin-side plug S being received in corresponding receptacles 93, 93' or clearances 95, 95' of the socket-side plug B, and also the housing mounting 21 of the pin-side mounting 2 in the housing mounting 401 of the socket-side mounting 400, so that a plug-in connection that is outwardly closed off completely is formed.

Figure 5:
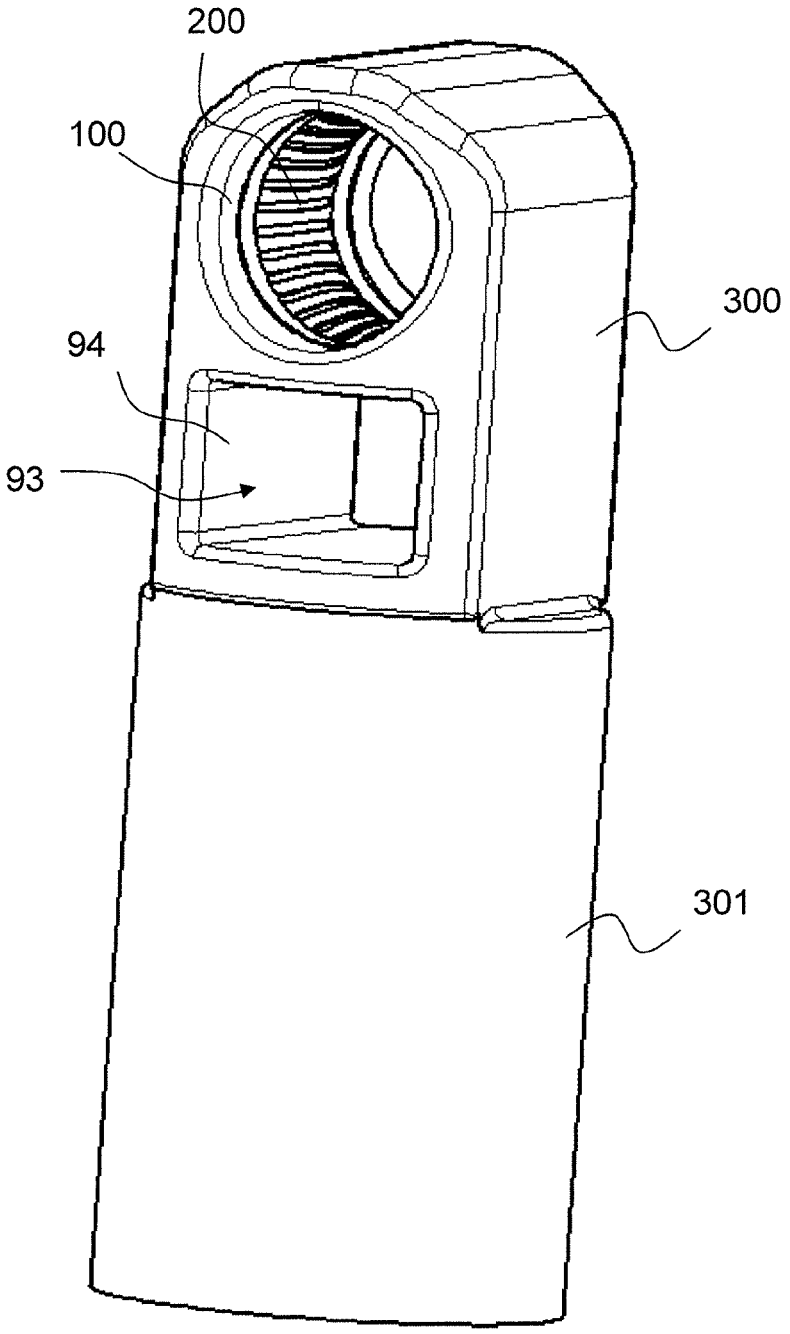
FIG. 5 shows a perspective view of a conductor element for a socket-side plug.

As revealed in particular by FIGS. 4 and 5, a contact element 200, here in the form of a contact lamella, which is designed for electrical contacting with the contact pin 3 of the pin-side plug S, is arranged in the socket 100. The contact lamella preferably extends in this case completely along the entire circumferential direction of the socket 100. The socket 100 in turn is arranged in a conductor element 300, which has a connection region 301 for a cable and in the embodiment shown here is formed perpendicularly to the plug base 91 of the socket-side plug housing 9. Instead of a connection region 301 formed perpendicularly to the plug base 91, a connection region arranged parallel to the plug base 91 may also be provided.

As explained above, the conductor element 300 provides part of the receptacle 93, 93'. The receptacle in this case penetrates the conductor element 300, whereby its cross section is weakened. The current path runs laterally in relation to the receptacle 93, 93'. The arrangement of the receptacle 93, 93' in the conductor element 300 provides the advantage that the conductor element 300 can be provided very easily. In other words, the protective element 5, 5' penetrates the conductor element, which has the advantage that the conductor element 300 does not have to be constructed around the end face of the protective element 5, 5'. That is to say that the conductor element 300 surrounds the protective element 5, 5' around its circumferential side or laterally, but not around the end face or the proximal end of the protective element. As a result, the housing can be made more compact.

Although not represented in the figures, the pin-side plug S may also have a connection region for a cable, which may likewise be arranged parallel or at an angle, in particular perpendicularly, to the pin-side plug housing 6.

The plug housing or socket housing described above or else other plug housings and socket housings are typically produced by an injection-molding process. The socket-side plug housing 9 comprises a shielding 500. The shielding 500 is molded onto an outer part 501 and/or an inner part 502. The particularly preferred method is as follows. The inner part 502 of the shielding 500 is first molded onto the shielding 500. After that, the outer part 501 of the shielding 500 is molded on. The shielding 500 could also be molded onto an outer part 501, with the inner part 502 being molded subsequently.

In particular in the case of multi-pole plug-in connectors, the outer part and inner part may also be molded onto the shieldings simultaneously. In this way, the shieldings are in a single plug housing.

LIST OF DESIGNATIONS

| | |
|---|---|
| S | Pin-side plug |
| B | Socket-side plug |
| 1 | Plug-in connector system |
| 2 | Pin-side mounting |
| 21 | Housing mounting |
| 22 | Housing base |
| 3, 3' | Contact pin |
| 31, 31' | Free pin end |
| 32, 32' | Base-side pin end |
| 33, 33' | Lateral surface |
| 4, 4' | Contact protection |
| 5, 5' | Protective element |
| 51, 51' | Base leg |
| 52, 52' | Side leg |
| 53, 53' | Side leg |
| 54, 54' | Outer surface |
| 55, 55' | Inner surfaces |
| 56, 56' | End face |
| 6 | Pin-side plug housing |
| 61 | Plug base |
| 62, 62' | Plug wall |
| 63, 63' | Interruption |
| 64, 64' | Inner surface |
| 65, 65' | Wall surface |
| 66, 66' | Arcuate portion |
| R1 | First direction |
| R2 | Second direction |
| LK | Length of contact pin |
| LS | Length of protective element |
| 67, 67' | Grooving |
| 7 | Protective element base |
| 8, 8' | Protective arrangement |
| 9 | Socket-side plug housing |
| 91 | Plug base |
| 92 | Plug wall |
| 93, 93' | Receptacle |
| 94, 94' | Inner surface |
| 95, 95' | Clearance |
| 100 | Socket |
| 200 | Contact lamella |
| 300 | Conductor element |
| 301 | Connection region |
| 400 | Socket-side mounting |
| 401 | Housing mounting |
| 402 | Housing base |
| 500 | Shielding |
| 501 | Outer part |
| 502 | Inner part |
| B | Arc center point |
| E | Plane |
| M | Center axis |
| BK | Width of contact pin |
| BS | Width of protective element |

The invention claimed is:

1. A pin-side plug for electrical connection to a socket-side plug, comprising:

a pin-side plug housing with a plug base and a plug wall, an electrically conducting contact pin with a free pin end and a base-side pin end for fastening the contact pin to the pin-side plug housing, and a protective element, which is designed to be electrically insulating, wherein the protective element is arranged on the pin-side plug housing at a distance from the contact pin;

wherein the protective element has a first portion, which is oriented along a first direction, and a second portion, which is oriented along a second direction and is intended for providing reinforcement with respect to a deformation of the first portion;

wherein the plug wall has at least one or two parallel wall surface(s) on its inner surface, facing the contact pin, or on its outer surface, facing away from the contact pin, which parallel wall surfaces are arranged lying opposite one another with respect to a center axis extending along the contact pin, from the base-side pin end in the direction of the free pin end, and/or are arranged in each case at an equal distance from the center axis; and wherein the plug wall has an arcuate portion, which connects the two parallel wall surfaces to one another in an arcuate manner and wherein the protective element is arranged with respect to the plug wall in a plane that is defined by the center axis and by an arc center point of the arcuate portion, and wherein the protective element is arranged in this plane midway between the parallel wall surfaces.

2. The pin-side plug as claimed in claim 1, wherein the protective element is formed separately from the contact pin and/or wherein the protective element is arranged at a distance in such a way that the protective element does not come into contact with a lateral surface of the contact pin;

and/or wherein the plug wall is designed to be electrically insulating and is arranged on the pin-side plug housing at a distance from the contact pin and/or wherein the protective element is arranged at a distance from the plug wall.

3. The pin-side plug as claimed in claim 1, wherein the plug wall extends at least partially along a circumferential direction around the contact pin, and/or wherein, seen transversely in relation to the center axis, the plug wall is at least in certain portions formed in cross section as a segment of a circle, or in a polygonal or rectangular or square manner or a mixed form of the aforementioned shapes and/or wherein the protective element and the plug wall are arranged virtually concentrically or eccentrically around the contact pin.

4. The pin-side plug as claimed in claim 1, wherein the plug wall is circumferentially interrupted.

5. The pin-side plug as claimed in claim 4, wherein the protective element is arranged the interruption of the plug wall.

6. The pin-side plug as claimed in claim 1, wherein said second direction is at an angle to the first direction.

7. The pin-side plug as claimed in claim 1, wherein the protective element and/or the plug wall are formed in one piece with the plug housing and form a protective arrangement for the contact pin.

8. The pin-side plug as claimed in claim 1, wherein said pin-side plug comprising two or more contact pins, wherein each contact pin has in each case a protective element and/or wherein an electrically insulating contact protection is arranged on the free end of the contact pin.

9. An arrangement comprising a pin-side plug and a socket-side plug for electrical connection to the pin-side plug said pin-side plug comprising:

a pin-side plug housing with a plug base and a plug wall, an electrically conducting contact pin with a free pin end and a base-side pin end for fastening the contact pin to the pin-side plug housing, and a protective element, which is designed to be electrically insulating, wherein the protective element is arranged on the pin-side plug housing at a distance from the contact pin, and said socket-side plug comprising:

a socket-side plug housing with a plug base and a plug wall, and a socket, which is arranged in the socket-side plug housing and is designed for receiving the contact pin in the connected state, wherein the socket-side plug housing has a receptacle for receiving the protective element in the connected state wherein the protective element has a first portion, which is oriented along a first direction, and a second portion, which is oriented along a second direction and is intended for providing reinforcement with respect to a deformation of the first portion, wherein the plug wall has at least one or two parallel wall surface(s) on its inner surface, facing the contact pin, or on its outer surface, facing away from the contact pin, which parallel wall surfaces are arranged lying opposite one another with respect to a center axis extending along the contact pin, from the base-side pin end in the direction of the free pin end, and/or are arranged in each case at an equal distance from the center axis, and wherein the plug wall has an arcuate portion, which connects the two parallel wall surfaces to one another in an arcuate manner and wherein the protective element is arranged with respect to the plug wall in a plane that is defined by the center axis and by an arc center point of the arcuate portion, and wherein the protective element is arranged in this plane midway between the parallel wall surfaces.

10. The arrangement as claimed in claim 9, wherein the socket is arranged in a conductor element, and wherein the receptacle for receiving the protective element extends into the conductor element.

11. The arrangement as claimed in claim 9, wherein the socket is arranged in a conductor element, and wherein the receptacle for receiving the protective element extends into the conductor element, and wherein the receptacle is arranged in the conductor element in such a way that the protective element is surrounded by the conductor element exclusively on its circumferential side, but not at its end face.

12. The arrangement as claimed in claim 9, wherein the conductor element has a connection region for a cable and in particular is formed at an angle or parallel to the plug base of the socket-side plug housing, and/or wherein in the connected state the receptacle at least partially encloses the protective element, wherein the protective element is preferably able to fit exactly in the receptacle and/or wherein the receptacle is preferably designed for receiving substantially the entire length of the protective element.

13. The arrangement as claimed in claim 9, wherein the receptacle has a substantially rectangular shape, wherein there is play between the inner surfaces and the outer surfaces of the protective element in the connected state, and/or wherein the receptacle surrounds the protective element preferably completely in the region of the receptacle; and/or wherein the socket-side plug housing has a further clearance, in particular in the form of a circle, in which the plug wall, in particular in the form of a segment of a circle, can be received; and/or wherein a contact element, in particular a contact lamella, which is designed for electrical contacting with the contact pin of the pin-side plug, is arranged in the socket.

14. The arrangement as claimed in claim 9, wherein the protective element is formed separately from the contact pin and/or wherein the protective element is arranged at a distance in such a way that the protective element does not come into contact with a lateral surface of the contact pin;

and/or wherein the plug wall is designed to be electrically insulating and is arranged on the pin-side plug housing at a distance from the contact pin and/or wherein the protective element is arranged at a distance from the plug wall.

15. The arrangement as claimed in claim 9, wherein the plug wall extends at least partially along a circumferential direction around the contact pin, and/or wherein, seen transversely in relation to the center axis, the plug wall is at least in certain portions formed in cross section as a segment of a circle, or in a polygonal or rectangular or square manner or a mixed form of the aforementioned shapes and/or wherein the protective element and the plug wall are arranged virtually concentrically or eccentrically around the contact pin.

16. The arrangement as claimed in claim 9, wherein the plug wall is circumferentially interrupted.

17. The arrangement as claimed in claim 16, wherein the protective element is arranged the interruption of the plug wall.

18. The pin-side plug as claimed in claim 9, wherein said second direction is at an angle to the first direction.

19. The arrangement as claimed in claim 9, wherein the protective element and/or the plug wall are formed in one piece with the plug housing and form a protective arrangement for the contact pin.

20. The arrangement as claimed in claim 9, wherein said pin-side plug comprising two or more contact pins, wherein each contact pin has in each case a protective element and/or wherein an electrically insulating contact protection is arranged on the free end of the contact pin.

21. The pin-side plug as claimed in claim 1, wherein said pin-side plug comprising two or more contact pins, wherein each contact pin has in each case a protective element and likewise at least in each case a plug wall and in each case a protective arrangement.

22. The pin-side plug as claimed in claim 8, wherein the electrically insulating contact protection has the form of a protective cap.

23. The pin-side plug as claimed in claim 9, wherein said pin-side plug comprising two or more contact pins, wherein each contact pin has in each case a protective element and likewise at least in each case a plug wall and in each case a protective arrangement.

24. The pin-side plug as claimed in claim 20, wherein the electrically insulating contact protection has the form of a protective cap.

25. A socket-side plug and a pin-side plug for an electrical connection with each other, said pin-side plug comprising:

a pin-side plug housing with a plug base and a plug wall, an electrically conducting contact pin with a free pin end and a base-side pin end for fastening the contact pin to the pin-side plug housing, and a protective element, which is designed to be electrically insulating, wherein the protective element is arranged on the pin-side plug housing at a distance from the contact pin, and wherein said socket-side plug comprises:

a socket-side plug housing with a plug base and a plug wall, and a socket, which is arranged in the socket-side plug housing and is designed for receiving the contact pin in the connected state, wherein the socket-side plug housing has a receptacle for receiving the protective element in the connected state, and wherein the socket is arranged in a conductor element, and wherein the receptacle for receiving the protective element extends into the conductor element, and wherein the receptacle is arranged in the conductor element in such a way that the protective element is surrounded by the conductor element exclusively on its circumferential side, but not at its end face.

26. The pin-side plug as claimed in claim 25, wherein the protective element is formed separately from the contact pin; and/or wherein the protective element is arranged at a distance in such a way that the protective element does not come into contact with a lateral surface of the contact pin; and/or wherein the plug wall is designed to be electrically insulating and is arranged on the pin-side plug housing at a distance from the contact pin; and/or wherein the protective element is arranged at a distance from the plug wall.

27. The pin-side plug as claimed in claim 25, wherein the plug wall extends at least partially along a circumferential direction around the contact pin, and/or wherein, seen transversely in relation to the center axis, the plug wall is at least in certain portions formed in cross section as a segment of a circle, or in a polygonal or rectangular or square manner or a mixed form of the aforementioned shapes, and/or wherein the protective element and the plug wall are arranged virtually concentrically or eccentrically around the contact pin.

28. The pin-side plug as claimed in claim 25, wherein the plug wall is circumferentially interrupted.

29. The pin-side plug as claimed in claim 28, wherein the protective element is arranged the interruption of the plug wall.

30. The pin-side plug as claimed in claim 25, wherein the protective element has a first portion, which is oriented along a first direction, and a second portion, which is oriented along a second direction and is intended for providing reinforcement with respect to a deformation of the first portion.

31. The pin-side plug as claimed in claim 30, wherein the first direction is oriented in angle to the second direction.

32. The pin-side plug as claimed in claim 25, wherein the plug wall has at least one or two parallel wall surface(s) on its inner surface, facing the contact pin, or on its outer surface, facing away from the contact pin, which parallel wall surfaces are arranged lying opposite one another with respect to a center axis extending along the contact pin, from the base-side pin end in the direction of the free pin end, and/or are arranged in each case at an equal distance from the center axis.

33. The pin-side plug as claimed in claim 32, wherein the plug wall has an arcuate or angular portion, which connects the two parallel wall surfaces to one another in an arcuate manner.

34. The pin-side plug as claimed in claim 32, wherein the plug wall has an arcuate portion, which connects the two parallel wall surfaces to one another in an arcuate manner and wherein the protective element is arranged with respect to the plug wall in a plane that is defined by the center axis and by an arc center point of the arcuate portion, and wherein the protective element is arranged in this plane midway between the parallel wall surfaces.

35. The pin-side plug as claimed in claim 25, wherein the protective element and/or the plug wall are formed in one piece with the plug housing and form a protective arrangement for the contact pin.

36. The pin-side plug as claimed in claim 25, wherein said pin-side plug comprising two or more contact pins, wherein each contact pin has in each case a protective element, and/or wherein an electrically insulating contact protection is arranged on the free end of the contact pin.

37. The pin-side plug as claimed in claim 25, wherein said pin-side plug comprising two or more contact pins, wherein each contact pin has in each case a protective element and likewise at least in each case a plug wall and in each case a protective arrangement.

38. The pin-side plug as claimed in claim 8, wherein the electrically insulating contact protection has the form of a protective cap.

39. The socket-side plug as claimed in claim 25, wherein the conductor element has a connection region for a cable and is formed at an angle or parallel to the plug base of the socket-side plug housing, and/or wherein in the connected state the receptacle at least partially encloses the protective element, wherein the protective element is preferably able to fit exactly in the receptacle, and/or wherein the receptacle is preferably designed for receiving substantially the entire length of the protective element.

40. The socket-side plug as claimed in claim 25, wherein the receptacle has a substantially rectangular shape, wherein there is play between the inner surfaces and the outer surfaces of the protective element in the connected state, and/or wherein the receptacle surrounds the protective element preferably completely in the region of the receptacle; and/or wherein the socket-side plug housing has a further clearance, in particular in the form of a circle, in which the plug wall, in particular in the form of a segment of a circle, can be received; and/or wherein a contact element, in particular a contact lamella, which is designed for electrical contacting with the contact pin of the pin-side plug, is arranged in the socket.

* * * * *